US012385211B2

(12) United States Patent
Cinquin et al.

(10) Patent No.: US 12,385,211 B2
(45) Date of Patent: Aug. 12, 2025

(54) ASSEMBLY FOR SECURELY COUPLING A TOOL ON A WORKING ARM OF A PUBLIC WORKS MACHINE WITH IMPROVED OPERATION

(71) Applicant: ACTEYS, Saint Victor (FR)

(72) Inventors: Didier Cinquin, Huriel (FR); Remi Ratnik, Durmignat (FR); Rene Sieffert, Odenas (FR)

(73) Assignee: ACTEYS, Saint Victor (FR)

( * ) Notice: Subject to any disclaimer, the term of this patent is extended or adjusted under 35 U.S.C. 154(b) by 797 days.

(21) Appl. No.: 17/698,218

(22) Filed: Mar. 18, 2022

(65) Prior Publication Data

US 2022/0298742 A1 Sep. 22, 2022

(30) Foreign Application Priority Data

Mar. 18, 2021 (FR) ..... 2102745

(51) Int. Cl.
*E02F 3/36* (2006.01)

(52) U.S. Cl.
CPC ..... *E02F 3/3618* (2013.01); *E02F 3/3622* (2013.01); *E02F 3/365* (2013.01)

(58) Field of Classification Search
CPC ..... E02F 3/3618; E02F 3/3663; E02F 3/3622; E02F 3/365; E02F 3/3645; E02F 3/3604; E02F 3/3627; E02F 3/3609
See application file for complete search history.

(56) References Cited

U.S. PATENT DOCUMENTS

| | | | | |
|---|---|---|---|---|
| 10,184,224 B2 * | 1/2019 | Ito | ..... | E02F 3/3663 |
| 2016/0281319 A1 * | 9/2016 | Park | ..... | E02F 3/365 |

FOREIGN PATENT DOCUMENTS

| | | | | |
|---|---|---|---|---|
| EP | 2860318 A1 * | 4/2015 | ..... | E02F 3/3618 |
| KR | 20200053356 A * | 5/2020 | | |
| KR | 20210056069 A * | 5/2021 | | |
| WO | WO-2014098616 A1 * | 6/2014 | ..... | E02F 3/3618 |
| WO | WO-2015199081 A1 * | 12/2015 | ..... | E02F 3/3604 |
| WO | WO-2018056841 A1 * | 3/2018 | ..... | E02F 3/3663 |
| WO | WO-2020002882 A2 * | 1/2020 | ..... | E02F 3/3609 |

* cited by examiner

*Primary Examiner* — Christopher J Sebesta
*Assistant Examiner* — Blake E Scoville

(57) ABSTRACT

Quick coupler for coupling a tool on a working arm of a public works machine, with two connection components equipping the tool, two coupling components for coupling with the connection components, a security component mounted for free rotation, at least one locking component, a translationally movable release component adapted to allow the security component to rotate. The release component with at least one translationally movable part adapted to be in contact with at least one surface, the shape of which is adapted to that of the security component, and a security component with at least one surface adapted to be in sliding contact with at least one complementary shaped surface of a connection component, the sliding contact inducing a rotation of the security component when the connection component moves out of its accommodation housing defined by the first coupling component.

14 Claims, 8 Drawing Sheets

[Fig. 1]
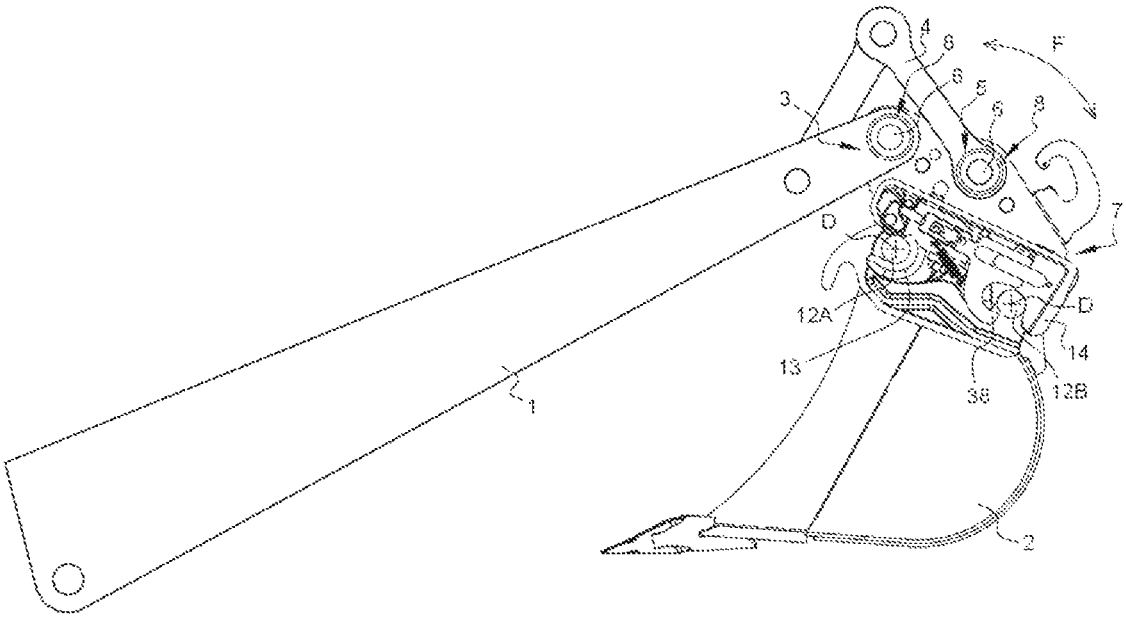
[Fig. 2]
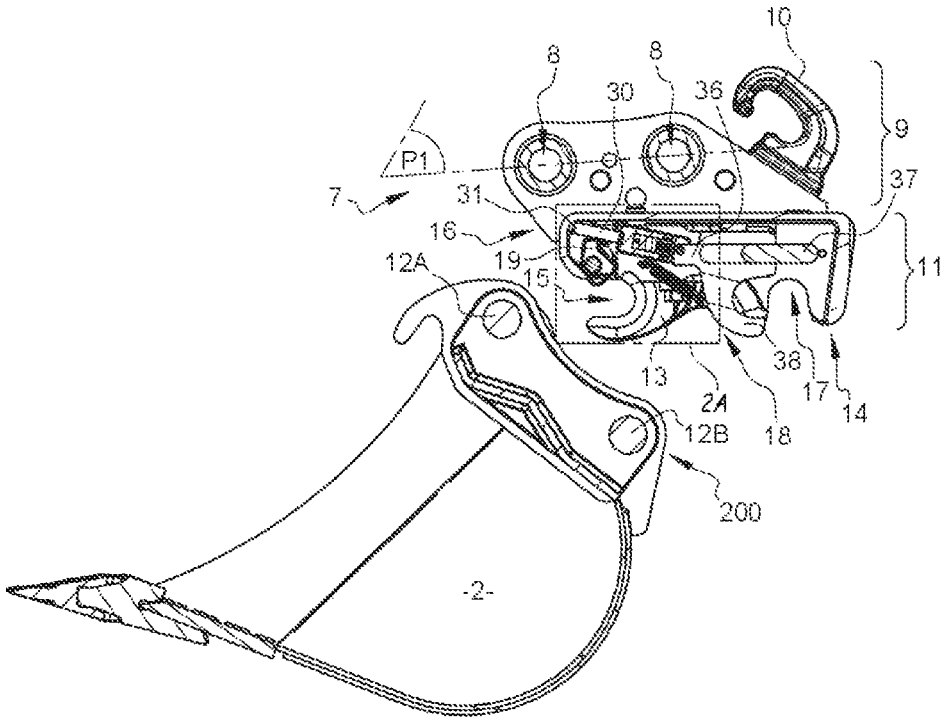

[Fig. 2A]
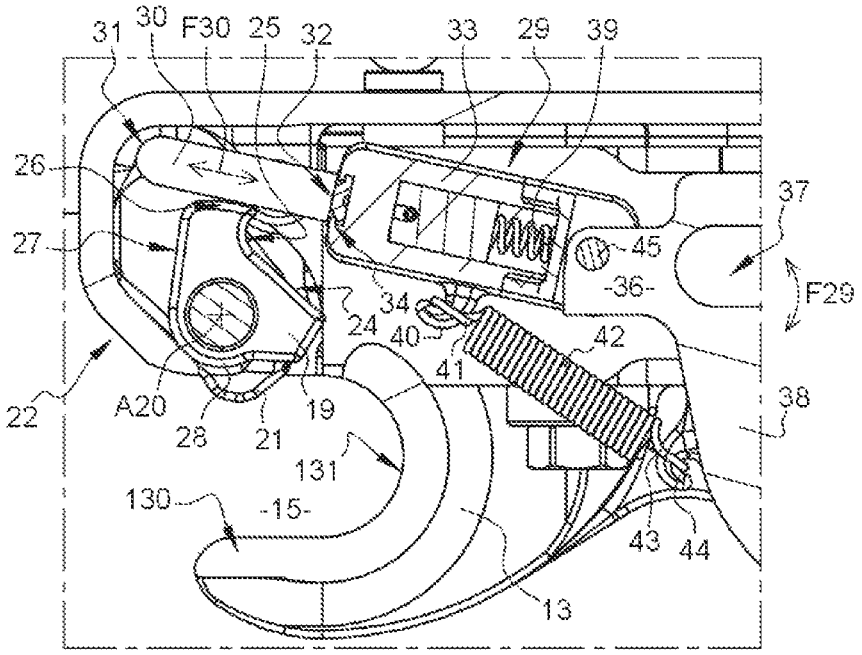
[Fig. 3]
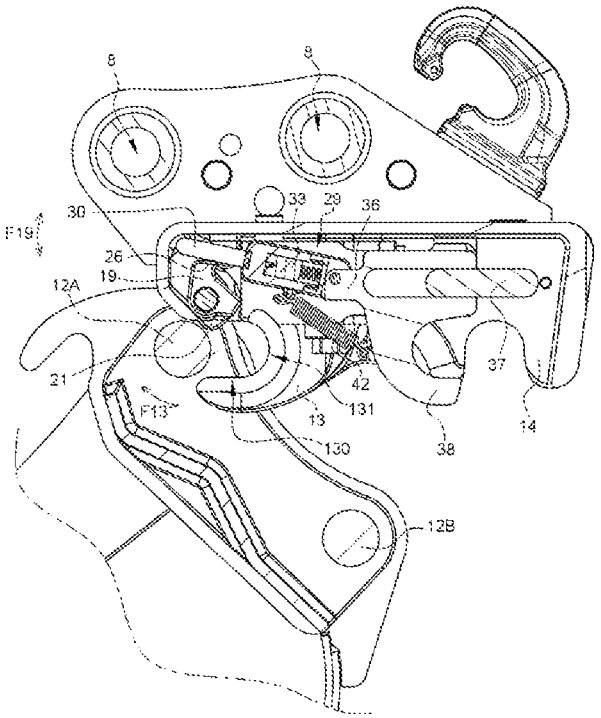

[Fig. 4
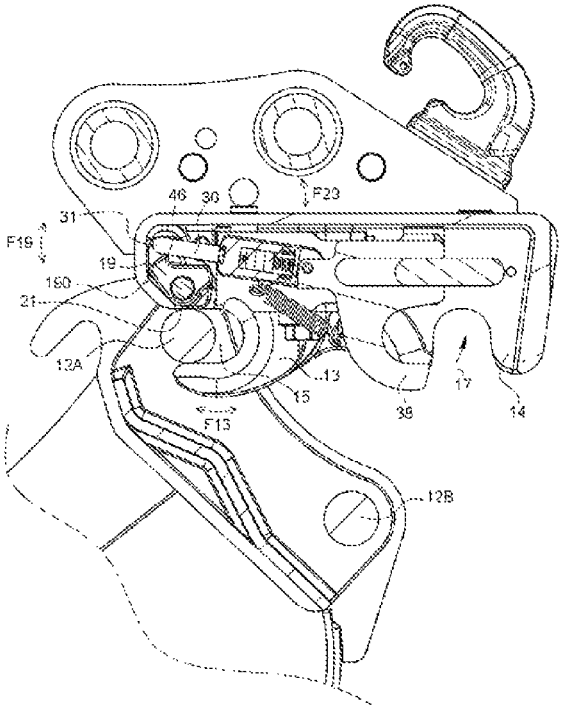
[Fig. 5]
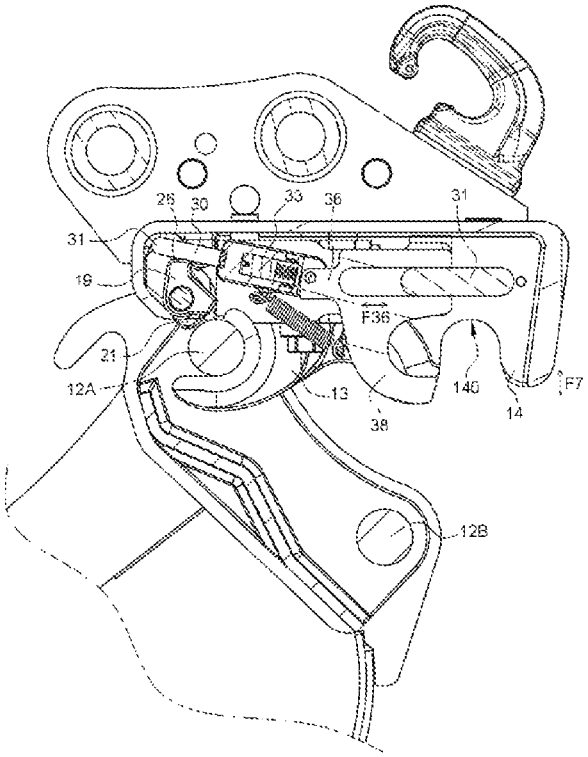

[Fig. 6]
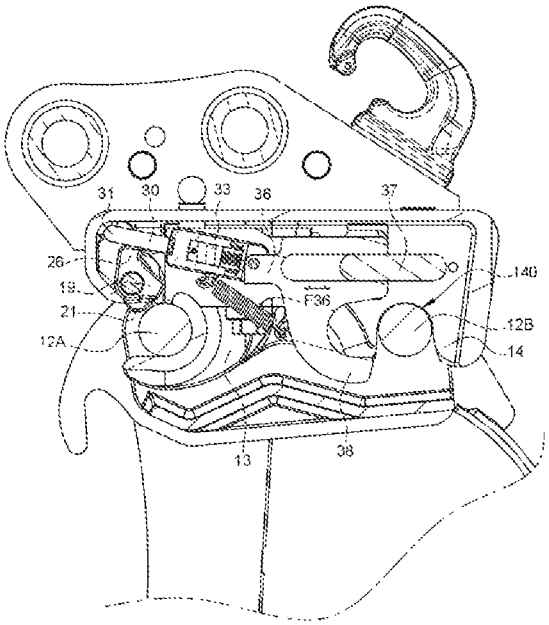
[Fig. 7]
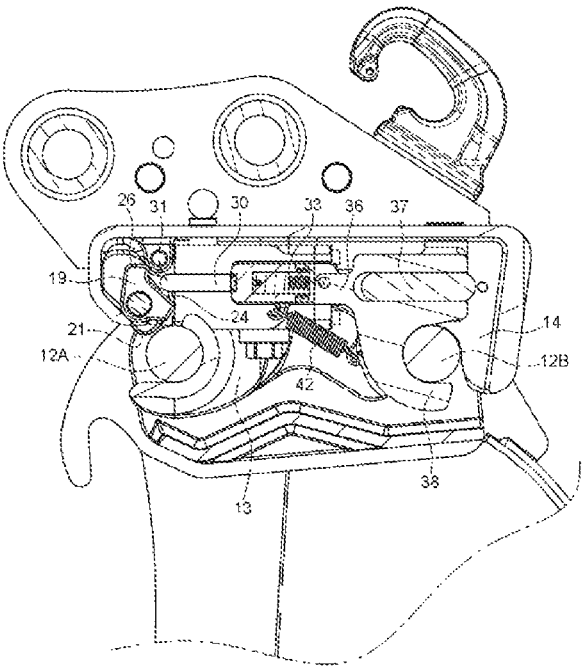

[Fig.8]
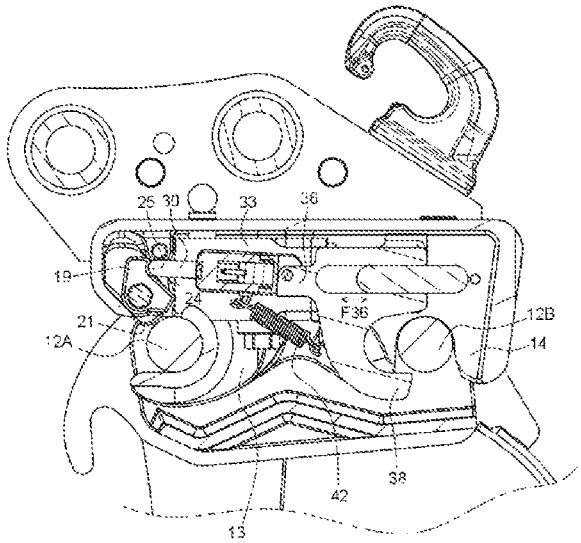
[Fig.9]
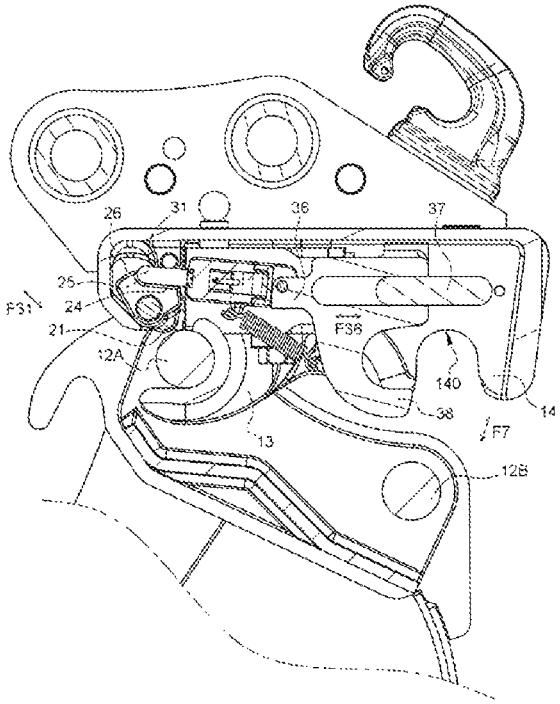

[Fig.10]
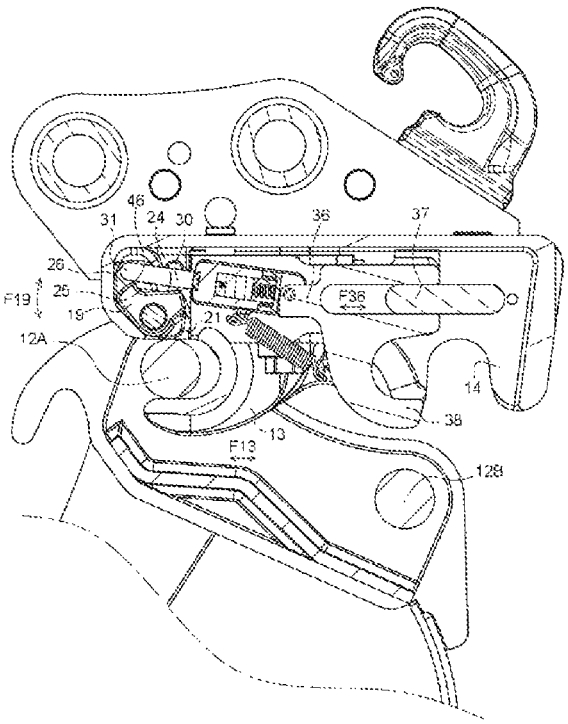
[Fig.11]
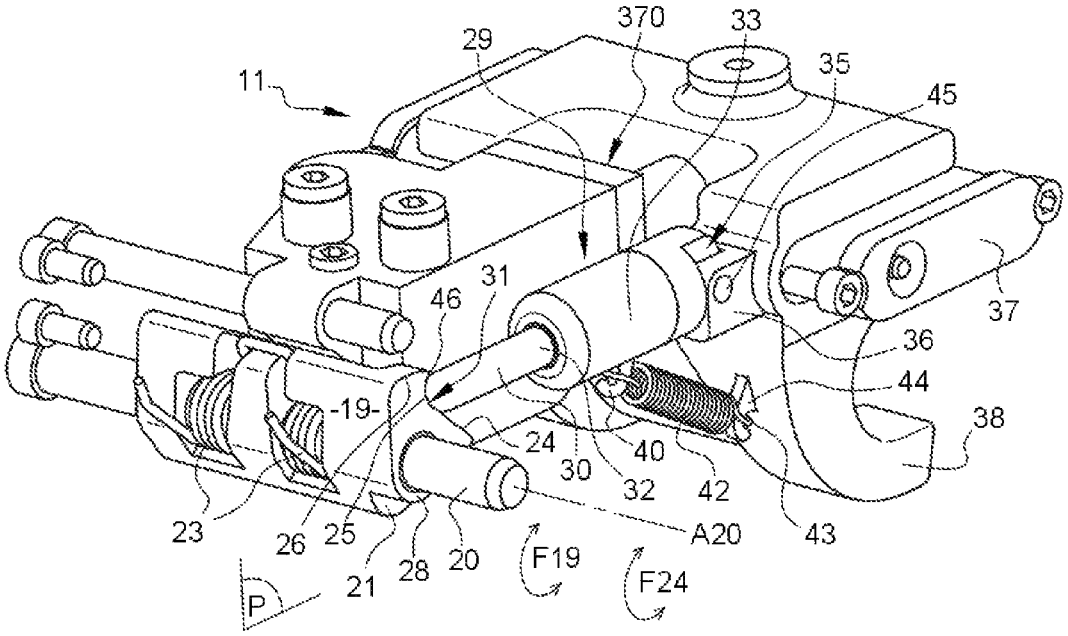

[Fig.12]
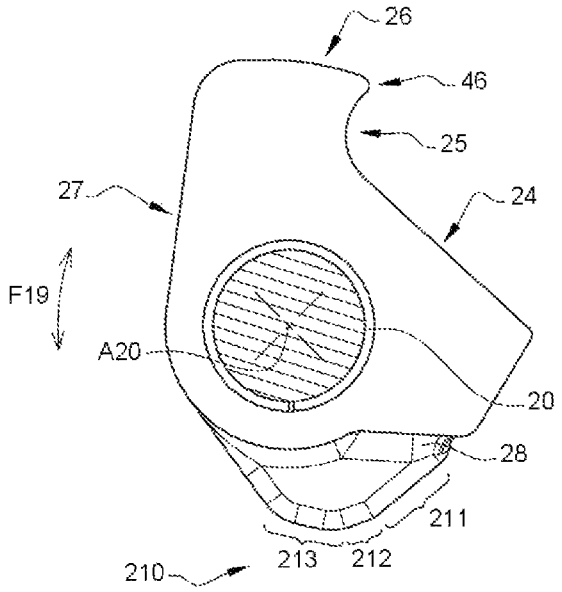
[Fig.13]
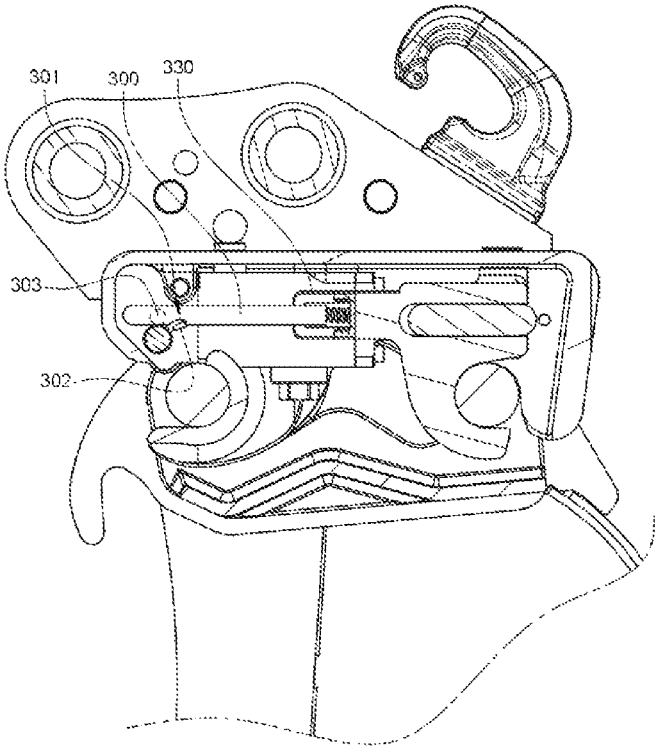

[Fig.14]
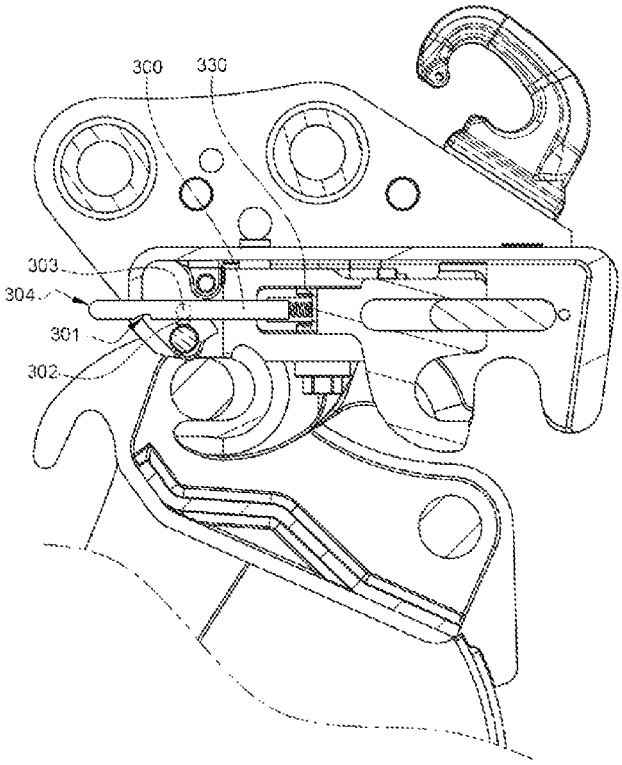

ASSEMBLY FOR SECURELY COUPLING A TOOL ON A WORKING ARM OF A PUBLIC WORKS MACHINE WITH IMPROVED OPERATION

The present invention relates to an assembly for securely coupling a tool on a working arm of a public works machine with improved operation.

DESCRIPTION OF RELATED ART

The expression public works machine denotes any machine, of the self-propelled vehicle type or a stationary machine, positioned on land, on a vessel, on a pontoon or on a railway vehicle, equipped with at least one arm, at the end of which a tool is detachably mounted, with said tool being of the shovel, bucket, gripper, chisel, hammer, basket, lifting hook type or any other tool used within the context of heavy on-site, civil engineering, transport, agricultural, mining and quarrying or handling work.

The arms of a public works machine can accommodate various tools, both by their function and by their size, in order to undertake different jobs. These tools can move along one or more axes relative to the end of the arm of the vehicle. A tool is coupled on the end of a working arm of a public works machine using a coupling assembly that comprises a plurality of parts and is known as a quick coupler assembly, more easily denoted using the expression "quick coupler," which will preferably be used hereafter.

Such a quick coupler allows the tool to be securely coupled to the working arm without human intervention. Many systems also allow the tool to be securely uncoupled from the working arm. The tools used on public works machines comprise two parallel connection shafts, allowing coupling with the quick coupler. Said quick coupler is provided with components for coupling and locking the shafts of the tool on the coupler. A coupler is known from EP-B-1 318 242 for which the translation movement of a jack, controlled by the user from the operating cab of the public works machine, ensures that the two coupling components of the quick coupler are locked and unlocked. WO-A-2020 128 075 describes a locking device in which a jack translationally activates hook-shaped coupling components adapted to retain the shafts of the tool. A blocking flap mounted for free rotation securely retains a coupling component on a shaft. The unlocking movement of the jack is accompanied by the compression of a spring, with said spring driving a part coming into abutment on the flap. Said flap is rotated to a position where it no longer prevents the shaft from exiting the retention component. EP-B-2 466 015 discloses a solution where two hooks form the shaft coupling components. A hook is directly connected by a pivoting link to the rod of a jack. The other hook is connected by a pivoting link to the rod of the jack by an arm. The movement of the rod of the jack successively induces the movements of the two hooks. EP-A-2 987 916 describes an activation component in the shape of a tuning fork that slides and pivots a component for blocking one of the shafts in position in the coupler. The disengagement of the shafts of the quick coupler may or may not be allowed depending on the position of the tuning fork-shaped component. The translation movement of the activation component, in one direction or the other, is subject to the action of a jack. The solution marketed by DROMONE ENGINEERING comprises a flap for locking a component for coupling the quick coupler with a shaft. The coupling component is moved by the action of a jack, with the locking flap pivoting into the active position under the effect of gravity. This maneuver requires tilting of the tool at the end of the arm. In this position, the other shaft is also locked by a coupling component that is moved by a jack. Unlocking the coupling components also requires tilting of the tool at the end of the arm so that the movement of the jack induces the movement of a lug acting on the flap. WO-A-2018/056841 relates to a quick coupler for coupling a tool. In a first example, the coupler comprises a fixed jaw, configured as a U-shape, and a second jaw mounted on a slide that can move under the action of a hydraulic jack. A spring pushes the slide away from one of the jaws. The coupler comprises a locking component allowing the connection component to be blocked and being configured in the shape of an L and pivotably mounted. A branch of the locking component forms an activation element. A finger defining an unlocking element is mounted on the slide. It is moved when the jack translationally moves. In this case, the movement of the unlocking components, as well as the movement of one of the jaws, is obtained by hydraulic means.

Such solutions require action by the user at least for resetting the device, i.e. returning the device to a position where it is ready to ensure set-up and coupling with a tool. In addition, these solutions are complex to implement and maintain.

Such solutions currently comply with the existing standards, in particular, European standards EN474-1/A3, EN474-1:2006+A5, as well as international standard ISO 13031 (2016) and machine directive: 2006/42/EC. With this being the case, if the operator of the public works machine performs movements with the arm of the vehicle, typically pendulum movements, without having correctly engaged the tool and/or locked the quick coupler, there is a risk of uncontrolled swinging of the tool around one of the connection shafts or of the tool breaking free, and therefore falling to the ground. This risk is even more marked as the coupling and uncoupling kinematics of certain solutions induce movements of the tool and/or a given position of said tool during its coupling and/or uncoupling with the quick coupler.

Currently, authorities wish to increase the level of security relating to the connection of tools with a quick coupler, as well as the information given to the user with respect to the state of the connection. In particular, the question of the tool potentially falling if the quick coupler is not correctly locked with the tool must be resolved. Therefore, a need exists for a coupling assembly between a tool and an arm of a public works machine, the installation of which tool is simple, secure, with optimized manufacturing and maintenance, while offering maximum assurance against any case of the tool potentially falling if the coupling between the tool and the quick coupler is not implemented correctly.

The invention proposes a response to this need by offering an assembly for coupling a tool on a working arm of a public works machine that is secure, easy to implement and guarantees increased safety by avoiding any risk of the tool unhooking as long as the coupling system is not in the unlocked position, while limiting the number of parts and being adaptable to various types of quick couplers and tools.

BRIEF SUMMARY OF THE INVENTION

To this end, the subject matter of the invention is an assembly for coupling a tool on a working arm of a public works machine, comprising a secure connection device, called quick coupler, two parallel connection components equipping the tool, at least one of the connection components being a cylinder with a circular base, two coupling components with the connection components equipping the secure connection device, said coupling components defining housings for accommodating the connection components, a security component mounted to freely rotate between a position, called disengaged position, in which it allows a first connection component equipping the tool to move relative to a first coupling component, and a position, called engaged position, in which it secures the retention of the first connection component by the first coupling component, at least one locking component that is movable between an inactive position, in which the retention by a second coupling component equipping the secure connection device of the second connection component is not locked, and an active position, in which it locks the retention by the second coupling component of the second connection component, a release component that is translationally movable and is adapted to allow the security component to rotate from the disengaged position to the engaged position, the release component comprising at least one translationally movable part that is fixed on the locking component, said movable part of the release component being adapted to be in contact with at least one surface of suitable shape secured to the security component and said security component comprising at least one surface adapted to be in sliding contact with at least one surface, the shape of which is adapted to the first connection component, said sliding contact inducing a rotation of the security component when the first connection component moves out of its accommodation housing defined by the first coupling component, characterized in that the rotation of the security component when the first connection component moves out of its accommodation housing defined by the first coupling component occurs in the counterclockwise direction, toward an edge of the lower part of the connection device, to a position in which the release component allows the security component to return to a position, called reset position, in which the security component is remote from the first connection component, without any coupling between the tool and the connection device, at least one surface of part of the security component being in a position, called engaged position, corresponding to a position where the engagement of said surface in the housing defined by the first coupling component is maximal, said housing being empty.

Thus, by virtue of the invention, the number of parts is limited, and therefore as is the risk of a malfunction, while facilitating maintenance and ensuring optimum safety, with accidental dropping of the tool during locking no longer being possible.

According to advantageous but non-compulsory aspects of the invention, such a coupling assembly can comprise one or more of the following features:

The security component comprises a round relief or flap, the radius of curvature of which is adapted to the radius of the cylinder with a circular base forming the first connection component, said relief comprising at least three flat and curved surface segments adapted to be successively at least facing at least part of the surface of the connection component.

A segment of the round relief is permanently at least facing part of the surface of the first connection component when said component is in its accommodation housing defined by the first coupling component.

The security component is retained in the engaged position by a return component.

The release component comprises a main body receiving a finger that is translationally movable in the body.

A return component permanently retains the finger outside the body of the release component.

A return component for positioning the body retains said body in a position in which the finger is at least permanently facing the security component.

The finger comprises at least one zone in contact with the security component and located at a free end of the finger when the retention of the second connection component by the second coupling component is not locked.

The finger comprises a notch adapted to receive a pawl that is free to rotate relative to the security component.

The pawl is secured to the security component, with a pin for rotating the pawl being secured to a wall of the quick coupler.

The end of the finger extends beyond the quick coupler when the security component is in the disengaged position, forming a visual signal for the user.

The locking component comprises a lug configured as a hook that is translationally movable in slides.

The slides are detachably mounted in the quick coupler.

The invention also relates to a public works machine provided with at least one working arm equipped with a coupling assembly for coupling a tool on the working arm in accordance with any one of the preceding features.

BRIEF DESCRIPTION OF THE VIEW OF THE DRAWINGS

The invention will be better understood, and further advantages thereof will become more clearly apparent, from reading the following description, which is provided solely by way of a non-limiting example and refers to the accompanying drawings, in which:

FIG. 1 is a partial side view of an arm of a public works machine equipped with a tool connected to the arm by a coupling assembly according to one embodiment of the invention;

FIG. 2 is a larger scale side view of the tool and of the secure connection device forming the coupling assembly of FIG. 1, alone and in the uncoupled position;

FIG. 2A is a larger scale view of the detail surrounded with broken lines in FIG. 2;

FIG. 3 is a larger scale partial view of the elements of FIG. 2, in a close position, with the first coupling component being ready to receive the first connection component of the tool;

FIG. 4 is a view similar to FIG. 3, with the first coupling component being in the process of receiving the first connection component of the tool, with the security component being in a position allowing engagement;

FIG. 5 is a view similar to FIG. 4, with the first connection and coupling components being mutually engaged, the security component being in position for securing the retention of the connection component in the accommodation housing defined by the coupling component;

FIG. 6 is a view similar to FIG. 5, with a second connection component of the tool and a second coupling component of the secure connection device being in the process of coupling;

FIG. 7 is a view similar to FIG. 6, with the two connection components of the tool being securely retained by the two coupling components of the secure connection device, the locking and security components being in an active position;

FIG. 8 is a view similar to FIG. 7, illustrating the beginning of the uncoupling of the tool and the quick coupler, with the locking component being in the process of transitioning to the inactive position;

FIG. 9 is a view similar to FIG. 8, with the security component having pivoted, the release component being at the end of its travel and the locking component being in the inactive position, the second connection and coupling components being uncoupled;

FIG. 10 is a view similar to FIG. 9, with the uncoupling of the first connection and coupling components being almost total, the assembly being in a configuration similar to that illustrated in FIG. 4;

FIG. 11 is a partial perspective view, to another scale, of part of the secure connection device or quick coupler of FIGS. 1 to 10 illustrating the various components;

FIG. 12 is a larger scale side view of the security component illustrated in FIGS. 1 to 10 alone; and FIG. 13 and FIG. 14 are views similar to FIGS. 7 and 10, respectively, of the invention according to another embodiment.

DETAILED DESCRIPTION OF THE INVENTION

FIG. 1 illustrates an arm 1 of a public works machine, with said machine being known per se and not being illustrated. In this case, it is a machine of the mechanical shovel type. It is easily understood that such a public works machine can be of another type, for example, an excavator, a backhoe, a dredger, a mower, a loading machine or more generally any self-propelled or non-self-propelled land, railway or maritime machine equipped with at least one working arm equipped with at least one working tool. In this case, the working tool 2 is a bucket. As an alternative embodiment, it can be another tool, for example, a blade, a rock breaker, a pestle, a basket, a crushing/clearing head or the like. The free end 3 of the arm 1 is equipped with an articulated lever 4. The end 3 and a free end 5 of the lever 4 are each provided with a rotation shaft 6. In this case, the shafts 6 are identical. As an alternative embodiment, they are different. These shafts 6 maintain and allow movement, following the double arrow F, of a secure connection device 7 for connecting the tool 2 on the arm 1. Such a device is frequently denoted using the expression "quick coupler," which will also be used hereafter. To ensure that the quick coupler 7 is retained on the rotation shafts 6, said shafts are inserted into complementary shaped orifices 8 provided on part of the quick coupler 7. Depending on the configuration of the end 3 of the arm 1, the lever 4, the number and/or the position of the rotation shafts 6, the quick coupler 7, and therefore de facto the tool 2, can be moved in one or more planes, given that the quick coupler can allow, depending on its configuration, the tool to rotate about a vertical axis. Thus, insofar as the configuration of the connection components of the tool allows, the tool 2 can be oriented in order to work toward the machine or away from the machine.

FIG. 2 is a larger scale representation of the tool 2 and the quick coupler 7 of FIG. 1, in the uncoupled position, i.e. before the tool 2 is mounted on the arm 1 or once the tool 2 is unhooked from the arm 1. In such a position, there is no connection, not even a partial connection, between the tool 2 and the arm 1. The secure connection device or quick coupler 7 is a set of parts, made of metal or made of one or more material(s) resistant to shocks and environmental stresses. As shown in FIGS. 1 to 14, the device 7 generally assumes the shape of a rectangular parallelepiped. It comprises a part 9 for fixing onto the arm 1. This part 9 forms the upper part of the coupler 7, with reference to FIG. 2. In addition to the orifices 8 for accommodating the rotation shafts 6, it comprises, in the illustrated embodiment, a lifting hook 10. The hook 10 allows lifting operations to be carried out using a sling. As an alternative embodiment, the part 9 is devoid of a hook 10 or the like. It is understood that the lifting hook 10, when present, can assume a shape and/or dimensions other than those illustrated in FIG. 2. The connection between the part 9 and the arm 1, even if it is detachable, generally remains permanently in place, so that the arm 1 is permanently equipped with the device 7. Thus, no particular maneuver when moving the public works machine is necessary, with the arm 1 always being ready to accommodate a tool 2. The device 7 can also be fitted as standard on the arm 1 of a public works machine or even retrofitted on the arm 1 of a public works machine, provided that the orifices 8 are adapted in terms of numbers, dimensions and positions to the rotation shafts 6 equipping the arm 1. To this end, according to another embodiment, not shown, the part 9 is detachable in order to be easily changed to adapt to the configuration of the arm 1.

The lower part 11 of the device 7, with reference to FIG. 2, is dedicated to the secure and detachable connection between the device 7, and therefore de facto the arm 1, and the tool 2. To this end, the tool 2 comprises at least two parallel connection components 12A and 12B. In the example illustrated in the various figures, there are two cylindrical metal shafts with a circular base of the same diameter and length. As an alternative embodiment, they are not identical in terms of dimensions and/or geometric shape. In all cases, at least one of the connection components is a shaft or a cylinder with a circular base. The connection components or shafts 12A and 12B are located on one end 200 of the tool 2. They are positioned and dimensioned to provide not only a secure connection of the tool 2 on the device 7, but also to provide easy and effective maneuvering of the tool 2. The parallel shafts or connection components 12A, 12B are oriented in a direction D that is substantially orthogonal to a longitudinal axis of the arm 1 when the tool 2 is mounted on the arm 1. By convention, with reference to their position illustrated in FIG. 1, relative to the free end 3 of the arm 1 when the tool 2 is mounted on the quick coupler 7, it is referred to as being the rear connection component, therefore the furthest from the arm 1 in FIG. 1, the connection component or shaft 12B and as being the connection component before the connection component or shaft 12A. It is understood that, when the tool 2 is oriented differently with respect to the arm 1, typically when it pivots 180° in a vertical plane, the front connection component is the component 12B, with the rear component being the component 12A, provided that they are identical.

The device 7 is equipped with at least two coupling components 13, 14 with connection components 12A and 12B, respectively. By analogy, the component 13 will be called front coupling component and the component 14 will be called rear coupling component. The front coupling component 13, located to the left of the part 11 with reference to FIG. 2, is configured as a hook, the opening 15 of which is oriented toward the side 16 defining a lateral edge of the device 7, in this case the left edge with reference to FIG. 2 connecting the parts 9 and 11. In other words, the opening 15 of the coupling component 13 is located as close as possible to the end 3 of the arm 1. It is therefore oriented toward the cab of the public works machine, not shown. The opening 15 defines a housing for accommodating the connection component 12A.

The rear coupling component 14 is configured as a U-shape, the opening 17 of which is oriented toward the lower edge 18 of the device 7 with reference to FIG. 2. The opening 17 defines a housing for accommodating the connection component 12B.

As shown in FIG. 2A, a security component 19 is mounted on the part 11, at the opening 15 of the coupling component 13. It is shown in perspective in FIG. 11 and, laterally, alone and on a large scale, in FIG. 12. As can be particularly seen from FIGS. 2A, 11 and 12, the security component 19 is pivotably mounted in a plane P about a rotation shaft 20, with a longitudinal geometric axis A20. The component 19 pivots in one direction or the other following the double arrow F19. The plane P is substantially perpendicular to a plane P1 connecting the rotation shafts 6 and illustrated in FIG. 2. The attachment 7 in this case is equipped with a single security component 19, as illustrated in FIG. 11. As an alternative embodiment, there are several components 19, depending on the dimensions of the connection components 12A, 12B.

The security component 19 is a part with a complex geometric shape, as shown in FIG. 11. It has an elongated shape, with a complex cross-section. The dimensions, in particular the length, of the security component 19 are adapted to the dimensions of the connection component 12A. As shown in FIG. 11, the ends of the shaft 20 extend beyond the ends of the component 19 and ensure that the component 19 is fixed in the sides of the coupler 7. For greater clarity, the sides of the coupler 7 are not shown in the various figures. It is easy to understand that the part 9 of the coupler 7 forms a protection for the active components of the part 11 of the coupler 7. Hereafter, the active engaged position of the component 19 will be defined as a position in which it prevents the connection component 12A from exiting its housing 15. The disengaged position of the component 19 corresponds to a position in which it does not prevent the component 12A from exiting its housing 15.

The security component 19 comprises, in the lower part with reference to FIGS. 11 and 12, a part 21 with a round relief, which will be referred to as flap hereafter. This flap 21 has a radius of curvature that is adapted to the radius of the cylinder with a circular base forming the connection component 12A.

The shape of the curvature of the relief 21 is complex, as shown in FIG. 12. Typically, the curved free edge 210 comprises a plurality of straight and curved surface segments. Each segment performs a given function, in relation to the position of the component 19. A first straight and generally flat surface segment 211, located to the right of FIG. 12, is adapted to face, and if necessary come into abutment against, a portion of the connection component 12A when the component 12A is in place in the housing 15 of the coupling component 13, as illustrated in FIG. 7, with it being understood that the abutment only occurs if moving the component 12A out of the housing 15 is initiated. In this case, the flap 21, and in particular the segment 211, secures the connection and prevents any uncoupling of the component 12A and the coupler 7. This position corresponds to a position, called active engaged position, of the component 19 and of the flap 21 when the connection component 12A is installed in its housing 15. In the working configuration, in which there is no movement of the component 12A with a view to it exiting the housing 15, a clearance of a few millimeters is provided between the segment 211 and the component 12A. In other words, the flap 21 is in the active engaged position, ready to come into abutment against the component 12A present in its housing 15, but without being in abutment against the component 12A so as not to generate any friction between the component 12A and the component 19.

To the left of the segment 211, the segment 212, which is also straight and substantially flat, is arranged angularly. The segment 212 is a release segment, allowing any blocking contact between the flap 21 and the component 12A to be avoided during the respective rotations of these two elements with respect to each other. To this end, the width of the segment 212 is the smallest of all the constituent segments of the edge 210.

To the left of the segment 212, the segment 213 comprises a straight portion positioned between two curved portions. The shape of the segment 213 allows, when the component 12A exits, the component 19 to rotate in the counterclockwise direction and therefore allows it to be placed in the disengaged position illustrated in FIG. 10, so that the flap 21 does not prevent the connection component 12A from exiting its housing 15. The counterclockwise direction is indicated with reference to FIG. 12, namely a rotation from right to left with reference to FIG. 12. Thus, the counterclockwise direction is defined as being the rotation of the security component 19 toward the lateral edge 16 of the part 11 of the coupler 7. In this position, the security component 19 can automatically return to a position, called reset position, as illustrated in FIG. 2, 2A or 3.

It should be noted that the security component 19 not only can be in a disengaged position where the security component 19 cannot prevent a movement involving the component 12A exiting its accommodation housing 15 and in an active engaged position for blocking the component 12A from exiting its housing 15, as described above, but also in another position, called reset position, once the component 12A is completely free of its housing 15 and is spaced apart from the component 19. In this reset position, the security component 19 is remote from the component 12A, with the housing 15 being empty and ready to accommodate a component 12A, with the security component 19 itself being ready to transition to the disengaged position, then to the active engaged position when the component 12A is in place in the housing 15, which is the case whereby the component 12A is inserted into its housing 15. In the reset position illustrated in FIGS. 2, 2A and 3, the flap 21, and therefore the component 19, is in a position similar to that illustrated in FIGS. 5 to 8, therefore a position corresponding to the engaged position. The component 19 can therefore occupy, in addition to a disengaged position, an engaged and active position, in which it blocks the component 12A from exiting the housing 15, and an engaged and inactive position where the housing 15 is empty and ready to accommodate a component 12A. The implementation of the constituent segments of the free edge 210 of the flap 21 occurs during a translation movement of the component 12A, in either direction, and induces, due to the configuration of the segments 211 to 213, a rotation of the component 19. The rotation of the component 19, and therefore of the flap 21, always occurs in the counterclockwise direction as defined above, therefore a rotation toward the edge 16 of the part 11 of the coupler 7.

As shown in FIGS. 1 to 10, the dimensions of the flap 21 are such that it partially extends, in the active engaged position and in the inactive engaged position, called reset position, into the opening 15 defined between the coupling component 13, configured as a hook forming one of the constituent jaws of the component 13, and an edge 22 of the part 11 of the coupler 7 forming the other jaw. A part, not referenced, of the edge 22 is substantially parallel to the rectilinear part 130 of the hook 13 and thus defines a U-shape therewith. In this way, the U-shaped opening 15 forms a housing for accommodating the connection component 12A of the tool 2. As an alternative embodiment, the hook 13 defines a housing for accommodating the connection component 12B, by turning over the tool 2 and provided that the components 12A and 12B are identical. In the reset position of the security component 19 illustrated in FIGS. 2 and 2A, therefore in a position in which there is no coupling between the tool 2 and the quick coupler 7, the flap 21 is in a position corresponding to the engaged position of the security component 19, where its engagement in the opening 15 is maximal, with it being understood that the accommodation housing defined by the opening 15 is empty. Such a position of the flap 21 corresponds to an inactive engaged position, called reset position, identical to the engaged position of the flap 21 when the component 12A is in place in its housing 15. The return and the retention of the security component 19, therefore of the flap 21, in this position is achieved by at least one return component, in this case springs 23, of the helical type and shown in FIG. 11. As an alternative embodiment, the return to position is obtained using another means, known per se, for example, a leaf spring, a tension spring, a compression spring, a jack. By virtue of the return component of the security component 19, the passage of said security component between the various positions—engaged and active with blocking of the component 12A in its housing 15, disengaged without blocking of the component 12A in its housing 15, engaged and inactive, called reset position, therefore in the absence of the component 12A in its housing 15—occurs without user intervention, only by the various movements of the component 12A relative to its housing 15 and a release component, described hereafter. Such an operation, which is purely mechanical, allows optimum securing of the connection between the component 12A and the coupler 7, irrespective of the state of this connection.

The security component 19 comprises, above the flap 21 with reference to FIGS. 2A and 12, a face 24 that is inclined toward the hook 13 and is flat for the most part. The high end 25 of the face 24, therefore that furthest from the hook 13, is curved and oriented inward, therefore toward the face 24. Thus, as a cross section, the face 24 is generally in the shape of a crook. The end 25 is extended by a face 26 that is flat and generally orthogonal to a longitudinal axis A20 of the rotation shaft 20. A flat face 27, generally perpendicular to the face 26, connects said face 26 to the lower face 28 that supports the flap 21.

The part 11 accommodates at least one release component 29. Said release component is positioned above the coupling components 13 and 14, in the vicinity of the security component 19. The release component 29 comprises a finger 30 configured as a solid cylinder with a cylindrical base, the free end 31 of which generally assumes a shape complementing that of the curved end 25 of the security component 19. Advantageously, the end of the finger 30 is configured as a cylinder with a circular base, the longitudinal axis of which is perpendicular to the longitudinal axis of the finger 30. As an alternative embodiment, not shown, the finger 30 is flattened, in the shape of a connecting rod.

The end 32 of the finger 30, opposite the end 31, is detachably or non-detachably inserted into a part forming the main body 33 of the release component 29. The body 33 is, in the example, configured as a hollow cylinder with a circular base. As an alternative embodiment, it assumes another shape, for example, a parallelepiped. One end 34 of the body 33 receives the end 32 of the finger 30. The opposite end 35, referenced in FIG. 11, of the body 33 is connected by a pivot link to a relief 36 forming a rotation support for the body 33. The body 33 rotates in a plane parallel to the plane P of rotation of the security component 19. The relief 36 is integrally formed with a lug 38 in the form of a hook and is slidably mounted in at least one slide 37. The translation movement of the lug 38, and therefore of the rotation support 36, occurs in a plane orthogonal to the plane P1. The translation movement of the lug 38 in the slide 37 is implemented by a displacement means, typically by a jack, hydraulic or other. As an alternative embodiment, the translation movement is manual. In all cases, the movement of the lug 38 is not automatic but requires an action on the part of the user of the coupling assembly, therefore of the driver of the public works machine. The opening of the hook-shaped lug 38 is oriented toward the opening 17 of the first coupling component 14. The lug 38 is dimensioned and positioned so that, during its translation movement in the slide 37, following the double arrow F36, it releases or blocks access to the opening 17. In other words, the lug or hook 38 allows the component 12B to be blocked in position in the housing defined by the opening 17 of the coupling component 14. De facto, the hook 38 grants or does not grant access allowing the connection component 12B to enter or exit the housing 17 defined in the coupling component 14 according to the position of the hook 38.

The finger 30, forming a first part of the release component 29, is translationally movable in the body 33, following the double arrow F30. The finger 30 is retained, in the inactive position, in a position where it extends as much as possible outside the body 33 using a return component or pusher 39, as illustrated in FIGS. 2 and 2A in particular. The return component 39 in this case is a mechanical spring jack. As an alternative embodiment, it is another type of return component known per se, for example, a pneumatic or hydraulic jack. In all cases, the return component 39 acts in order to permanently push the finger 30 out of the body 33, irrespective of the position of the finger and irrespective of the forces acting on the finger.

The body 33, forming a second part of the release component 29, is provided with a hook 40, the opening of which is directed toward the finger 30. This hook 40 is adapted to detachably accommodate one end 41 of a helical spring 42, the other end 43 of which is connected to a hook 44 that is fixed on a face of the lug 38. When the spring 42 is connected to the two hooks 40 and 44, its return force induces a pivoting movement of the assembly of the release component 29 oriented downward following the double arrow F29, this occurs by rotating the end 35 of the body 33 about the rotation shaft 45 equipping the rotation support 36. In another embodiment, the helical spring 42 is replaced by another return component, for example, a leaf pressure spring positioned above the body 33 and exerting a pressure on the body 33 and inducing a pivoting movement of the whole of the release component 29 that is also oriented downward. In all cases, using the spring 42 or using another return component, the release component 29 is retained in a position such that it is always in contact with or facing, at least by one zone, in particular its free end 31, the security component 19, in particular with the flap 21, with this occurring during the various translation and rotation movements of the components 19 and 29. Thus, the release component 29 is facing the security component 19 when said security component is in the active engaged position and is ready to ensure, through contact, that the component 12A is blocked in the housing 15 when an attempt is made to remove the component 12A from the housing.

The operation of the secure connection device or quick coupler 7 will now be described with reference to the various FIGS. 1 to 14. The operation will first be described with reference to attaching a tool 2 on the device 7, therefore when installing the tool 2 on the arm 1 of a public works machine, then when removing the tool 2, for example, during a tool change.

In all cases, when attaching the tool, this necessarily implies that the tool is stationary relative to the arm 1, for example, placed on any surface, generally on the ground. In one embodiment, not shown, a security device can be provided that comprises sensors placed on the quick coupler 7 and/or the arm 1 and/or the tool 2 indicating, using an audible and/or visual signal, that the components 12A, 12B are engaged in the connection components 13, 14 and that the coupling between the tool 2 and the coupler 7 is complete and secured.

FIGS. 2 and 2A illustrate a configuration in which the tool 2 and the quick coupler 7 are completely separated, for example, before mounting or after dismounting the tool 2 on/from the arm 1 of a public works machine, therefore a configuration in which all the constituent elements of the coupling assembly are inactive. In this case, the openings or housings 15 and 17 of the coupling components 13 and 14 are completely free and accessible. The security component 19 is in the position in which the flap 21 extends as much as possible into the housing 15, which is empty. This corresponds to an engaged and inactive position of the security component 19. The face 27 of the security component 19 is substantially vertical and the face 26 is substantially horizontal. The flap 21 is retained in this position by the return of the spring 23. The finger 30 of the release component 29 is in abutment on the face 26 of the security component 19. In this configuration, the free end 31 of the finger 30 is at its top dead center or at the end of its travel, above the locking component 19. In this position, the finger 30 and the body 33 of the release component 29 are inclined upward, with reference to FIGS. 2 and 2A, by pivoting the body 33 about the shaft 45. The return force of the spring 42 tends to bring the release component 29 downward, therefore to keep it in abutment against the face 26. In this case, the contact zone between the security component 19 and the finger 30 is formed, respectively, by a portion of the face 26 and a portion of the outer surface of the finger 30, which in this case is cylindrical with a circular base. The security component 19 is ready to pivot, with the release component 29 not opposing a movement of the security component 19 when the component 12A is inserted into its housing 15. The component 19 then pivots in the counterclockwise direction, with reference to FIGS. 2 to 10, therefore toward the edge 16 of the part 11 of the coupler 7. Such a direction of rotation corresponds to a rotation of the component 19 toward the lower edge 22 of the part 7, tending to bring the edge 27 of the component 19 parallel to the edge 22. In other words, the end 26 of the component 19 pivots toward the opening 15.

In this configuration, the hook-shaped lug 38 is at an end of travel dead center, corresponding to free and maximum access to the opening 17 of the first coupling component 14. In other words, the locking component formed by the lug 38 is in the inactive position. The lug 38 is retained in this position by the fact that the jack, which is schematically shown by reference sign 370, which activates the lug 38 and therefore the release component 29, is inactive in the retracted position. Starting and stopping the jack 370 are controlled by the user of the coupling assembly, for example, the driver of the public works machine from the operating cab or by a user equipped with a remote control unit and remote from the machine, for example, when said machine is automated and does not comprise an operating cab.

FIG. 3 illustrates an initial phase of positioning the quick coupler 7 in order to connect with the tool 2, with said tool being stationary on a surface, the connection components 12A, 12B being accessible, the edge 200 of the tool 2 being oriented upward. Firstly, the coupling component 13 needs to be arranged facing the connection component 12A. The passage of the component 12A in the opening 15 of the coupling component 13, toward the round bottom 131 of the component 13, following the double arrow F13, induces contact between the flap 21, therefore the security component, and the periphery of the body 12A. The contact is initially made by the segment 213 of the flap 21 and the component 12A. The round relief 21 has a radius of curvature of the edge 210 that is adapted to that of the cylinder with a circular base forming the component 12A, so that the contact between these two parts is of the sliding type. In other words, such a type of contact allows the parts to move relative to each other. Thus, the translation movement of the component 12A toward the bottom 131 of the coupling component 13 rotates the security component 19, by means of the pivoting of the flap 21, with the segments 213 or 212 of the edge 210 being in contact with the component 12A. The security component 19 then pivots in the counterclockwise direction, as previously defined following the double arrow F19. This pivoting brings the flap 21, and therefore the security component 19, into a disengaged position, illustrated in FIG. 4, in which it is generally aligned with the edge 22. In this position, the flap 21 does not extend into the housing 15 of the component 13. In the embodiment illustrated in FIG. 4, the pivoting of the flap 21 in this direction is limited by a stop 190.

In this disengaged position of the flap 21, and therefore of the component 19, induced by the component 12A when it is inserted into the housing 15 defined by the coupling component 13, the passage of the component 12A is free and unimpeded. In addition to suppressing the flap 21, pivoting the component 19 brings the face 26 to a bottom dead center. In this position, the finger 30 no longer rests on the face 26, as illustrated in FIGS. 2 and 3, but only on a corner 46 defined by the junction between the face 26 and the curved end 25 of the inclined face 24. The contact surface between the security component 19 and the release component 29 is therefore minimal. The return force exerted by the spring 42 constantly keeps the finger 30 in abutment on the component 19. The finger 30, and in particular its free end 31, has therefore lowered and is located in the vicinity of the round part 25 of the security component 19.

The movement of the component 12A toward the round bottom 131 of the component 13, following the double arrow F13, continues until the component 12A is in abutment on the bottom 131 and on the rectilinear part 130 of the component 13. The component 13 then surrounds the component 12A by more than two thirds of its circumference, as illustrated in FIG. 5. In this configuration for retaining the component 12A in the component 13, the flap 21 has returned to a position similar to its initial position, which is the inactive engaged position initially illustrated in FIG. 2, with the component 12A not being present in FIG. 2. This return to position occurs automatically, by pivoting the component 19 in the other direction following the double arrow F19. This is rendered possible by the fact that the segments 212 and 213 of the flap 21 are in sliding contact with peripheral complementary shaped surfaces of the component 12A, the flap 21 and the component 12A with appropriate radii of curvature. In order for the rotation of the flap 21, and therefore of the security component 19, to occur automatically in the opposite direction to the rotation of the component 12A, with the finger 30 being in abutment on the component 19, there is a provision for the return force of the spring 23 to be greater than the return force of the spring 42.

In the position illustrated in FIG. 5, the free end 31 of the finger 30 is substantially located in the same position as that illustrated in FIG. 3. FIG. 5 therefore represents the retention of the component 12A in the component 13 and the securing of this retention by the flap 21. At this stage, the component 12B is not in position in the component 14 but it is facing the opening or housing 17 of the component 14. To introduce the component 12B into the component 14, the coupler 7 needs to be lowered toward the tool 2, following the double arrow F7. It should be noted that, at this stage, the coupling between the components 12A and 13 is secure, any accidental removal of the component 12A from the housing defined by the component 13 is impossible due to the engaged position of the security component 19, namely the position where the segment 211 of the flap 21 is facing the component 12A and prevents the component 12A from exiting the housing 15. This configuration is achieved mechanically, irrespective of the position of the tool 2 and of the coupler 7, without any user intervention on the security component 19. In one embodiment, a visual and/or audible signal, for example, based on sensors on the component 12A, and/or the segment 211, and/or the component 13, notifies the user of the secure coupling between the components 12A and 13. In other words, at this stage, even if the tool swings, said tool remains attached to the coupler 7, without any risk of falling.

The coupler 7 is then positioned as shown in FIG. 6. The two other components 12B and 14 now need to be coupled, by pivoting the coupler 7 about the component 12A following the double arrow F7. At the end of the movement, the connection component 12B is in abutment on the bottom 140 of the coupling component 14. In this configuration, the coupling of the components 12B and 14 is not secure, with the component 12B being able to freely exit the component 14, by a pivoting movement in the opposite direction to that previously described following the double arrow F7. In other words, in this position the coupling between the tool 2 and the coupler 7 is not completely achieved, with only the connection between the component 12A and the component 13 being secure. It is possible to provide, in another embodiment, an audible and/or light signal notifying the user that the coupling is not yet complete and secure. To this end, for example, contactors are available on the bottoms 131, 140 of the components 13 and 14.

To secure the connection between the component 12B and the component 14, the hook-shaped lug 38 must translationally move following the double arrow F36 toward the component 14. This movement is performed by sliding in the slide 37. The sliding movement is advantageously generated by the jack 370 controlled by the user, either from the operating cab of the public works machine or by a remote control. As an alternative embodiment, the movement of the hook or lug 38 is performed by a manual action, therefore with the intervention of the user, using a device for pushing or pulling the hook 38. When the hook or lug 38, which defines a locking component, is in abutment against the component 12B, therefore in the active position, it locks the retention of the connection component 12B by the coupling component 14. The hook shape of the lug 38 prevents any removal of the component 12B. In the position illustrated in FIG. 7, the security component 19 is in the active engaged position and secures the retention of the component 12A. The retention of the component 12A by the security component 19 is secured before transitioning to the active position of the locking component 38, which locks the retention of the component 12B. Locking the retention of the components 12A and 12B occurs one after the other. The tool 2 is thus securely coupled with the quick coupler 7.

In this configuration, the release component 29 has moved back following the double arrow F36, to a second end of translation movement travel limit. This movement has moved, by sliding the finger 30 on the face 26, the finger 30 substantially opposite the round part 25 but without any contact with the part 25 or with the face 24 of the security component 19. This movement is provided by the return force exerted by the spring 42 on the body 33. This movement, which is directed downward following the double arrow F29, is limited by the support 36, which, configured as a U-shape, defines a stop that stops any pivoting of the body 33 and therefore of the finger 30. In this configuration, the tool 2 can be used without any risk of accidental unhooking thereof. In another embodiment, an audible and/or light signal notifies the user of the complete and secure coupling of the tool 2 on the coupler 7. Such light signals can be obtained by color markings of the parts or parts of parts forming the coupling assembly. As an alternative embodiment, sensors fixed on the various connection and coupling components are used and generate an audible and/or light signal where the user is located, generally the cab of the public works machine.

To unhook the tool 2 from the coupler 7, the movement illustrated in FIG. 8 is initiated. To this end, the tool 2 needs to be maintained a few centimeters or decimeters above a surface, in order to allow the component 12B to disengage from the housing defined by the coupling component 14 under the effect of gravity, by pivoting the tool 2 about the connection component 12A. Once the coupling component 12B has been disengaged, the tool is placed and immobilized on a surface in order to continue uncoupling the tool 2 and the coupler 7.

This movement involves moving the locking component 38 in the direction of the double arrow F36 but in the opposite direction with respect to the movement that allowed coupling between the components 12B and 14. In other words, in this case, the movement aims to move the hook 38 away from the component 12B. This movement brings the end 31 of the finger 30 into contact against the round part 25 of the security component 19. The spring 42 retains the body 33 and therefore the finger 30 in a horizontal position, with the body 33 remaining in abutment against the support 36.

By continuing the movement of the hook 38 in the slide 37 to the end of the stroke of the jack 370 or of the manual translation means, the release component 29 is pushed back toward the component 13, as illustrated in FIG. 9. Since the body 33 is pivotably mounted about the shaft 45 and due to the complementary shapes of the end 31 and of the face 25, the movement of the finger 30, when continued beyond the simple contact between the face 25 and the end 31, is no longer horizontal, but tends to be slightly curvilinear and inclined upward, following the arrow F31 in FIG. 9. In this way, the translation movement of the hook 38 thrusts the finger 30 on the face 25 and initiates the rotation of the locking component 19, and therefore of the flap 21, about the axis of rotation A20, following the double arrow F19. The rotation occurs in the same counterclockwise direction as described above, when the component 12A is introduced into its housing 15. This movement brings the flap 21 opposite the component 12A. In this position, the flap 21 is in a generally completely disengaged position, therefore substantially coplanar with the edge 22 and it no longer opposes the removal of the component 12A, following the double arrow F31. To this end, the attachment 7 is translationally moved by a translation movement in the opposite direction to that described in FIGS. 3 to 5, in order to uncouple the components 12A and 13. The component 12A is removed with constant contact with the flap 21, in particular with the segment 212 of the flap 21.

By continuing to remove the component 12A from the component 13, as shown in FIG. 10, the tool 2 is completely released from the secure connection device 7. When the component 12A is removed, a sliding contact is made between the segment 213 of the flap 21 and the component 12A. During this contact, due to the configuration of the segment 213 and its bearing on the component 12A, the flap 21, and therefore the security component 19, is rotated during the translation movement of the component 12A. The security component 19 therefore rotates in the counterclockwise direction, as described above, and continues until the end 31 of the finger 30 passes above the component 19 and only rests on the security component 19 at the corner 46, in the same position as that illustrated in FIG. 4. A hard stop 190, or, as an alternative embodiment, an adjustable screw introduced into part of the wall 22 of the coupler 7, limits the rotation of the security component 19.

This removal movement of the component 12A therefore allows the security component 19 to return to the reset position, with the flap 21 and the surfaces 211 to 213 then being in the inactive engaged position, so that the component 19 is ready to be implemented for the following connection between a tool 2 and the coupler 7, without any human intervention, mechanically and automatically. Indeed, when the component 12A is completely disengaged from the component 13, nothing opposes the return force of the spring 23 and the security component 19 returns to its inactive engaged position and the flap 21, and therefore the surfaces 211 to 213, returns to the inactive engaged position, as in FIG. 2A. It is then possible to reset a procedure for coupling a tool on the quick coupler.

FIGS. 13 and 14 illustrate another embodiment of the invention. Common elements with the previous embodiment have the same reference signs. The distinct elements of this embodiment use the same reference signs of the elements with the same function of the previous embodiment, multiplied by 10. A finger 300, which can have a circular, square, rectangular or oval cross-section, is inserted via one end into a body 330 that is fixed directly on the lug 38. In this way, only a translation movement of the finger 300, in the same direction as the movement of the lug 38, is possible. The length of the finger 300 is such that, in the configuration illustrated in FIG. 13, in which the coupling between the components 12A, 12B, 13 and 14 is locked and secure, it occupies almost all the space available in the coupler 7. A spring, similar to the spring 39, is inserted into the body 330 and ensures that a constant thrust force is applied to the finger 300. The finger 300 is provided with a notch 301. The notch 301 has a generally inclined bottom, toward the body 330, with a substantially vertical wall defining the edge of the notch 301 closest to the body 330. A pawl 302, pivotably mounted on the component 19, is installed in the notch 301. The shape and dimensions of the pawl 302 are adapted to those of the notch 301, with said notch defining a housing for accommodating the pawl 302. The pawl 302 is mounted on a position return spring, not shown. When uncoupling is initiated, similarly to the first embodiment, pivoting of the component 19 is initiated, by means of the pawl 302 engaged in the notch 301, subject to the thrust of the finger 300, which moves translationally. In this case, pivoting the component 19 brings the pawl in the vicinity of a pin 303 secured to one of the walls of the coupler 7. The pin 303 has a substantially circular section in the example. In all cases, the shape and the position of the pin 303 are such that when there is contact between the pin 303 and the pawl 302, this causes said pawl to tilt, which releases it from the notch 301. The translation movement of the finger 300 continues and the rotation movement of the component 19 continues until the disengaged position is reached, illustrated in FIG. 14, which allows the component 12A to exit the housing 15. The exit of the component 12A causes an additional rotation of the component 19, which causes the continuation of the movement of the pawl 302 by the pin 303. The pawl 302 is then disengaged from the notch 301, which allows the component 19 to freely rotate and therefore to return to the reset position, in a position defined by a stop, not shown, with the component 12A being out of its housing 15. During this movement, according to an advantageous embodiment, the free end 304 of the finger 300 extends beyond the coupler 7 through an orifice provided therein. The end 304 defines a visual signal for the user, as illustrated in FIG. 14, once the tool 2 is released from the coupler 7. Such a signal allows the state of the device to be checked, namely locked or unlocked depending on whether or not the finger extends out of the coupler 7. In another embodiment, not illustrated, the pawl is fixed on the finger 300, with a notch being provided on the component 19. In this case, the pin 303 is fixed on the component 19, causing the pawl to tilt out of the notch. In the embodiment of FIGS. 13 and 14, the maintenance of the device is facilitated, by limiting any ingress of dust and dirt into the coupler 7. Indeed, the presence of a single translation movement of the release component allows a seal to be used at the various openings, both in the body 330 and the opening provided in the face of the coupler 7 through which the end 304 of the finger 300 exits. In addition, the risk of an operating incident is also limited, with the kinematics being simplified.

By virtue of the invention, no human intervention is necessary for the security component to return to the reset position. This resetting is completely mechanical, as is the blocking of the security component 19 in the engaged position by the respective movements of the connection and coupling components and while maintaining kinematics for implementing the coupler 7 that are similar to those of the prior art. The invention offers, unlike the prior art, ternary operation of the security component, with automatic passage, without human intervention and by mechanical means, between three noteworthy positions: an active engaged position of the component 19, in which it blocks the component 12A from exiting its housing, a disengaged position of the component 19, in which the component 12A can exit its housing, and an inactive engaged position, called reset position, of the component 19, in which the component 19 has no effect on the component 12A, with said component being remote from the component 19, which, in the engaged position, is ready to repeat a connection cycle with the component 12A.

The transition between these three positions is induced by the movements of the component 12A relative to its housing 15 and by the movement of the unlocking component 29, when the component 12A enters or exits its housing 15. Such kinematics are obtained by a particular geometric configuration of the security component 19 and of the unlocking component 29, of the return components 42, 370, as well as by their respective positions in the coupler 7.

As a result, no human intervention is necessary for resetting the security component, since this occurs automatically using mechanical means, without any risk of forgetting or of errors. In other words, this optimizes the safety of the operations for assembling and disassembling a tool on an arm of a public works machine, by avoiding any malfunctions of a hydraulic or electrical system or any omission or incorrect operation by the user. Furthermore, maintaining such a coupling assembly is optimized, since the constituent elements are easy to dismantle.

In an advantageous embodiment, the slides 37 are detachably mounted in the coupler 7, facilitating the cleaning and maintenance of the coupler.

In one embodiment, the user is visually and/or audibly notified of the resetting of the safety device 19, or more generally its position.

The invention claimed is:

1. An assembly for coupling a tool (2) on a working arm (1) of a public works machine, comprising:

a secure connection device (7), called a quick coupler, two parallel connection components (12A, 12B) equipping the tool (2), at least one connection component of the two parallel connection components (12A, 12B) being a cylinder with a circular base, two coupling components (13, 14) configured to equip the secure connection device via the two connection components (12A, 12B), the two coupling components (13, 14) defining housings (15, 17) for accommodating the two parallel connection components (12A, 12B), a security component (19) mounted to freely rotate (F19) between a disengaged position, in which the security component allows a first connection component (12A) of the two parallel connection components equipping the tool (2) to move relative to a first coupling component (13) of the two coupling components, an engaged position, in which the security component secures retention of the first connection component (12A) in the first coupling component (13) and a reset position, in which the first connection component (12A) is remote from the first coupling component (13), without any coupling between the tool (2) and the connection device (7), at least one locking component (36, 38) that is movable (F36) between an inactive position, in which retention by a second coupling component (14) of the two coupling components equipping the secure connection device (7) of a second connection component (12B) of the two parallel connection components is not locked, and an active position, in which the at least one locking component locks the retention by the second coupling component (14) of the second connection component (12B), wherein a force acting on the at least one locking component (36, 38) moves the at least one locking component from the active position to the inactive position and from the inactive position to the active position, a release component (29) that is adapted to allow the security component (19) to rotate (F19) from the engaged position to the disengaged position in response to movement (F36) of the at least one locking component (36, 38), the release component (29) being pivotably secured (33) on the at least one locking component (36, 38) and comprising a finger (30) that is translationally movable (F30), the finger (30; 300) of the release component (29) adapted (30, 301) to be in contact with at least one release component surface (26, 46, 25, 24; 302) of the security component (19), and the security component (19) further comprising at least one first connection component surface (21, 211, 212, 213) adapted to be in sliding contact with the first connection component (12A), the sliding contact of the at least one first connection component surface with the first connection component (12A) inducing a rotation (F19) of the security component (19) from the reset position to the disengage position when the first connection component (12A) moves into its accommodation housing (15) defined by the first coupling component (13) while the at least one locking component (36, 38) is in the inactive position, wherein the rotation (F19) of the security component (19) to allow the first connection component (12A) to move out of the accommodation housing (15) defined by the first coupling component (13) occurs in a counterclockwise direction due to the at least one locking component (36, 38) being moved from the active position to the inactive position, causing the finger to contact the at least one release component surface of the security component, the finger forcing the securing component to rotate toward an edge (22) of a lower part (11) of the connection device (7) and moving the security component from the engaged position to the disengaged position, and after removal of the first connection component (12A) from the accommodation housing, the release component (29) allows the security component (19) to return to the reset position.

2. The coupling assembly according to claim 1, wherein the security component (19) comprises surface a round relief or flap having the at least one first connection component surface (21), a radius of curvature of the round relief or flap adapted to radius of the cylinder with a circular base forming the first connection component (12A), the at least one first connection component surface (21) comprising at least three flat and curved surface segments (211, 212, 213) adapted to be successively at least facing at least part of a surface of the connection component (12A).

3. The coupling assembly according to claim 2, wherein a segment (211) of the round relief (21) is permanently at least facing part of the surface of the first connection component (12A) when the first connection component is in the accommodation housing (15) defined by the first coupling component (13).

4. The coupling assembly according to claim 1, wherein the security component (19) is retained in the engaged position by a return component (23).

5. The coupling assembly according to claim 1, wherein the release component (29) comprises a main body (33; 330) configured to receive the finger (30; 300) that is translationally movable (F30) in the body (33; 330).

6. The coupling assembly according to claim 5, wherein a return component (39) is inserted into the body (330) and ensures that a constant force is applied to the finger (300), retaining the finger (30; 300) outside the body (33; 330) of the release component (29).

7. The coupling assembly according to claim 5, wherein a return component (42) for positioning the body (33) retains the body in a position in which the finger (30) is capable of interacting with the security component (19).

8. The coupling assembly according to claim 5, wherein the finger (30) comprises at least one zone in contact with the security component (19) and located at a free end (31) of the finger (30) when the retention of the second connection component (12B) by the second coupling component (14) is not locked.

9. The coupling assembly according to claim 5, wherein the finger (300) comprises a notch (301) adapted to receive a pawl (302) that is free to rotate relative to the security component (19).

10. The coupling assembly according to claim 9, wherein the pawl (302) is secured to the security component (19), with a pin (303) for rotating the pawl (302) being secured to a wall of the quick coupler (7).

11. The coupling assembly according to claim 9, wherein an end (304) of the finger (300) extends beyond the quick coupler (7) when the security component (19) is in the disengaged position, forming a visual signal for the user.

12. The coupling assembly according to claim 1, wherein the locking component (36, 38) comprises a lug configured as a hook (38) that is translationally movable (F36) in slides (37).

13. The coupling assembly according to claim 12, wherein the slides (37) are detachably mounted in the quick coupler (7).

14. A public works machine provided with at least one working arm (1) equipped with the coupling assembly (7) for coupling the tool (2) on the working arm (1) in accordance with claim 1.

* * * * *